US005962957A

United States Patent [19]

Tanaka et al.

[11] Patent Number: 5,962,957

[45] Date of Patent: Oct. 5, 1999

[54] SPARK PLUG FOR INTERNAL COMBUSTION ENGINE

[75] Inventors: Yutaka Tanaka; Minoru Ando; Mitsutaka Yoshida, all of Aichi, Japan

[73] Assignee: NGK Spark Plug Co., Ltd., Aichi, Japan

[21] Appl. No.: 08/821,624

[22] Filed: Mar. 24, 1997

[30] Foreign Application Priority Data

Mar. 29, 1996 [JP] Japan ..... 8-099493

[51] Int. Cl.[6] ..... H01T 13/20; H01T 13/22; H01T 13/34; H01T 13/36

[52] U.S. Cl. ..... 313/141; 313/141; 313/143; 313/144; 313/145; 123/169 EL

[58] Field of Search ..... 313/118, 123, 313/127, 132, 139, 140, 141, 142, 143–45; 123/169 EL

[56] References Cited

U.S. PATENT DOCUMENTS

| | | | |
|---|---|---|---|
| 3,139,553 | 6/1964 | Schwartzwalder . | |
| 3,346,760 | 10/1967 | Jalbing et al. | 313/145 |
| 3,538,021 | 11/1970 | Achey | 313/145 |
| 3,577,355 | 5/1971 | Blum | 313/145 X |
| 4,814,665 | 3/1989 | Sakura et al. | 313/141 |
| 5,760,533 | 6/1998 | Saiki et al. | 313/141 X |

FOREIGN PATENT DOCUMENTS 6-46587 6/1994 Japan .

OTHER PUBLICATIONS

Patent Abstracts of Japan, vol. 014, No. 429 (E–0978), Sep. 14, 1990 & JP 02 165587A (NGK Spark Plug Co Ltd), Jun. 26, 1990—Abstract.

*Primary Examiner*—Sandra O'Shea
*Assistant Examiner*—Mack Haynes
*Attorney, Agent, or Firm*—Evenson, McKeown, Edwards & Lenahan, PLLC

[57] ABSTRACT

By heating a glass sealing material, a center electrode is sealed and fixed within an axial bore of an insulator. Formation of a groove in a head portion of the center electrode makes it possible to protect the head portion of the center electrode from deformation under a pressure which is applied upon filling the glass sealing material in a powder form in the axial bore. The glass sealing material is therefore assured to flow to a peripheral side wall of a flange portion of the center electrode, thereby enhancing mechanical engagement between the center electrode and the insulator, that is, uniting strength for them. A spark plug is hence obtained with improved impact resistance and accordingly, with sufficient durability.

12 Claims, 5 Drawing Sheets

SPARK PLUG FOR INTERNAL COMBUSTION ENGINE

BACKGROUND OF THE INVENTION a) Field of the Invention

This invention relates to a spark plug for an internal combustion engine, especially to the structure of a center electrode held on an insulator in a spark plug to be fitted in an internal combustion engine.

b) Description of the Related Art

Upon holding a center electrode in an insulator of a spark plug to be fitted in an internal combustion engine, it has heretofore been the practice to seal under heat the center electrode at a head portion thereof together with a terminal electrode with a glass sealing material within an axial bore of the insulator. It has been proposed in Japanese Patent Application Laid-Open (Kokai) No. HEI 2-165587 that a conical recess is formed in a head portion of a center electrode to increase the flowability of a molten glass sealing material upon heating and sealing the center electrode together with the glass sealing material within an axial bore of an insulator, thereby improving the bonding between the head portion of the center electrode and the glass seal and thus enhancing the fixing strength of the center electrode within the axial bore of the insulator, and also to facilitate header machining required for the head portion of the center electrode prior to the sealing.

The above-described conventional technique is however accompanied by drawbacks as will be described next. To fixedly hold the center electrode together with the terminal electrode within the axial bore of insulator, the glass sealing material is filled in the form of powder in the axial bore of the insulator and is then heated together with the center electrode to seal the center electrode. During this filling of the powdery glass sealing material and/or the heating and sealing of the center electrode, a pressure is exerted on the conical recess in the head of the center electrode, leading to a potential problem that the conical recess in the head portion of the center electrode may be deformed, specifically flattened. As a consequence, the mechanical fitting engagement between the head portion of the center electrode and the glass seal as intended to be achieved owing to the formation of the conical recess in the head portion of the center electrode, in other words, the bonding strength between the glass seal and the center electrode may be reduced. As the insulator is exposed to pressure of combustion gas produced as a result of combustion of an air-fuel mixture in a combustion chamber, the center electrode fixedly held within the axial bore of the insulator is required to have sufficient impact resistance. The center electrode may not be able to exhibit such sufficient impact resistance due to the above-mentioned reduced bonding strength.

Further, the above-mentioned deformation, namely, flattening of the conical recess in the head portion of the center electrode leads to a diametrical enlargement of the head portion of the center electrode. Although the glass sealing material is supposed to flow in the powdery form or in a molten form to the peripheral side wall of the flange portion of the center electrode upon filling the glass sealing material in the powder form or heating the same, the flow of the glass sealing material is blocked by the enlarged head portion of the center electrode. As a result, a space is formed along the peripheral side wall of the flange portion of the center electrode. It is therefore possible to produce only very low bonding strength between the insulator and the center electrode, leading to the problem that the sufficient impact resistance required for the center electrode cannot be achieved as in the above-mentioned case.

SUMMARY OF THE INVENTION

An object of the present invention is to eliminate or otherwise lessen the above-described draw-backs of the conventional art, and specifically to sufficiently improve the impact resistance of the center electrode by devising the head portion of the center electrode so that the filling of the glass sealing material can be facilitated.

In one aspect of the present invention, there is accordingly provided a spark plug for an internal combustion engine, said spark plug having:

an insulator defining therein an axial bore including a small-diameter forward bore and a large-diameter rearward bore divided from each other by a stepped portion, a cylindrical center electrode provided with a head portion and a large-diameter flange portion arranged in continuation with the head portion, said cylindrical center electrode being inserted in the small-diameter bore with the flange portion maintained in engagement with the stepped portion, a terminal electrode, and a glass seal integrally sealing the head portion and the terminal electrode within the large-diameter bore, characterized in that a diametrically-extending groove is formed in the head portion of the center electrode or a polygonal prismatic, for example, triangular, preferably right triangular prismatic recess is formed in the head portion of the center electrode with vertices thereof located in internal contact with a peripheral edge portion of the center electrode to satisfy the following formulas:

$$13 \leqq B/A \times 100 \leqq 40$$

$$10 \leqq C/A \times 100 \leqq 35$$

where

A: diameter of the head portion of the center electrode,

B: maximum distance from an edge portion of the groove, which is formed in the head portion of the center electrode, to a peripheral edge portion of the center electrode; or maximum distance from one of sides connecting together the vertices, which are located in internal contact with the peripheral edge portion of the center electrode, to the peripheral edge portion of the center electrode, and C: height of projections formed in the head portion of the center electrode as a result of the formation of the groove or recess.

If desired, a downwardly-pointed depression, preferably a conical depression or a polygonal, for example, triangular pyramidal depression may be formed in a bottom of the groove or polygonal prismatic recess formed in the head portion of the cylindrical electrode.

Owing to the formation of the diametrically-extending groove or polygonal prismatic recess of predetermined dimensions defined by the above formulas in the head portion of the center electrode and further the optional formation of the downwardly-pointed depression in the bottom of the groove or polygonal prismatic recess, the head portion of the center electrode is protected from deformation which would otherwise take place under a pressure exerted via the terminal electrode upon filling a glass sealing material into the axial bore of the insulator and/or upon heating the glass sealing material for sealing the center electrode. The flowability of the glass sealing material to a peripheral side wall of the flange portion of the center electrode is surely retained so that the mechanical engagement between the center electrode and the insulator, namely, their bonding force is enhanced. This makes it possible to provide sufficiently improved impact resistance against impact force produced upon ignition of an air-fuel mixture within a combustion chamber. The present invention can therefore bring about the excellent advantage that the durability of the spark plug itself can be sufficiently maintained.

DETAILED DESCRIPTION OF THE INVENTION AND PREFERRED EMBODIMENTS

The present invention will hereinafter be described further with reference to the accompanying drawings.

Figure 1:
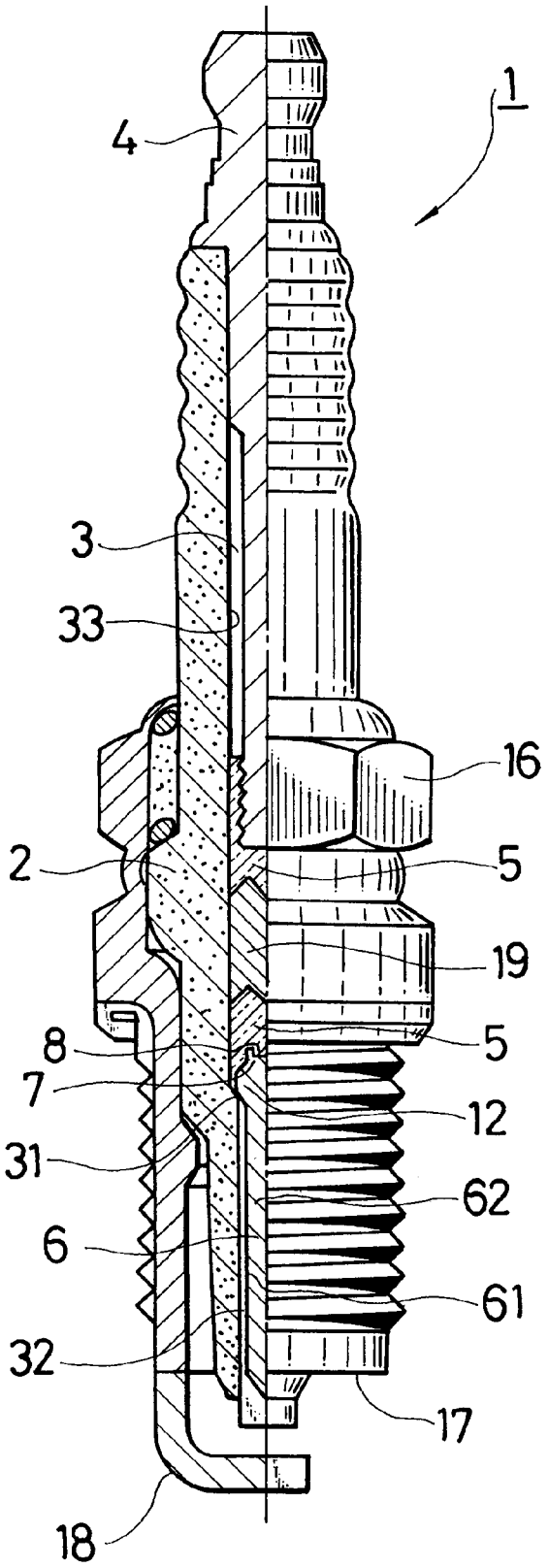
FIG. 1 is a partial cross-sectional view of a spark plug according to a first embodiment of the present invention for an internal combustion engine.
Figure 2A:
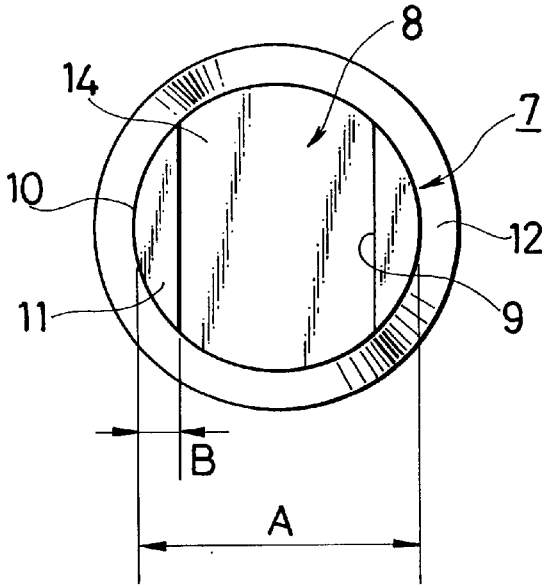
FIG. 2A is an enlarged fragmentary front view of a head portion of a center electrode in the spark plug according to the first embodiment of the present invention.
Figure 2B:
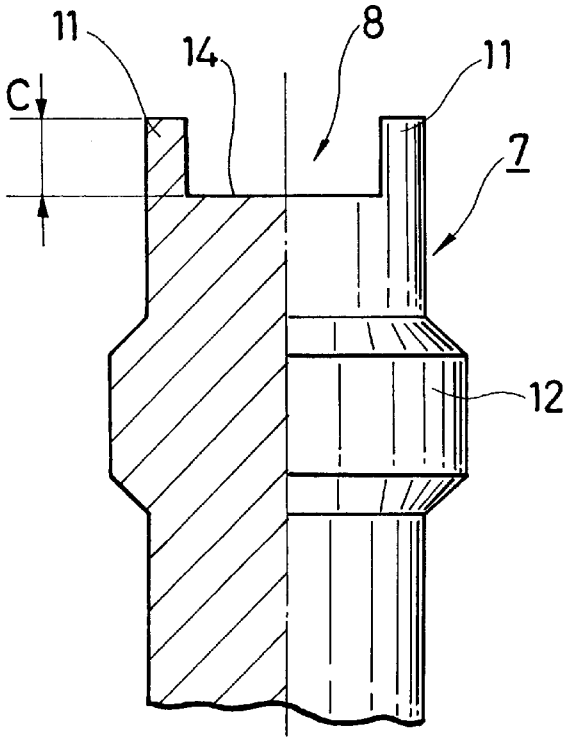
FIG. 2B is an enlarged fragmentary cross-sectional view of the head portion of FIG. 2A.

Referring first to FIGS. 1, 2A and 2B, the spark plug 1 according to the first embodiment of the present invention will be described. The spark plug 1 is composed of an insulator 2, a metal shell 16 internally holding the insulator 2, and a ground electrode 18 arranged extending from a ring-shaped end face 17 of the metal shell 16. The insulator 2 defines therethrough an axial bore 3, which includes a small-diameter forward bore 32 and a large-diameter rearward bore 33 divided from each other by a stepped portion 31. A cylindrical center electrode 6, which is provided with a head portion 7 and a large-diameter flange portion arranged in continuation with the head portion 7, is inserted in the small-diameter bore 32 with the stepped portion 31 maintained in engagement with the flange portion 12. Within the large-diameter bore 33, the head portion 7 and a terminal electrode 4 are integrally sealed by an electrically-conductive glass seal 5. A monolithic resistor 19 is generally embedded in the glass seal 5. The center electrode 6 is composed of a composite electrode which is in turn formed of a Ni-alloy shell 61 and a core 62 made of a metal having good thermal conductivity, such as Cu or a Cu alloy and sealed within the Ni-alloy shell 61.

Reference is next had to FIG. 2A and 2B. According to the first embodiment of the present invention, a diametrically-extending groove 8 is formed in the head portion of the center electrode 6 to satisfy the following formulas:

$$13 \leqq B/A \times 100 \leqq 40$$

$$10 \leqq C/A \times 100 < 35$$

where

A: diameter of the head portion 7 of the center electrode 6,

B: maximum distance from an edge portion 9 of the groove 8, which is formed in the head portion 7 of the center electrode 6, to a peripheral edge portion 10 of the center electrode, and C: height of projections 11 formed in the head portion 7 of the center electrode 6 as a result of the formation of the groove 8.

As the center electrode 6 within the axial bore 3 of the insulator 2 in the spark plug 1 according to the first embodiment of the present invention is constructed as described above, the groove 8 formed within the optimized dimensional range in the head portion 7 of the center electrode 6 makes it possible to prevent deformation of the head portion 7 of the center electrode 6 under a pressure which is applied through the terminal electrode 4 upon first filling a glass sealing material 5 in the form of powder in the axial bore 3 and/or then heating the powdery glass sealing material 5 to fixedly seal the center electrode 6 with the glass seal 5 within the axial bore 3 of the insulator 2. Accordingly, the glass sealing material 5 is surely allowed to flow to a peripheral side wall of the flange portion 12 of the center electrode 6 and moreover, the mechanical fitting engagement between the glass seal 5 and the head portion 7 of the center electrode 6 is improved by the groove 8 formed in the head portion of the center electrode 6. The bonding strength between the center electrode 6 and the insulator 2 is thus enhanced, so that the impact resistance to impact force produced as a result of combustion of an air-fuel mixture within a combustion chamber of an internal combustion engine, said impact resistance being required for the spark plug 1 to be fitted in the internal combustion engine, is fully improved.

Figure 3A:
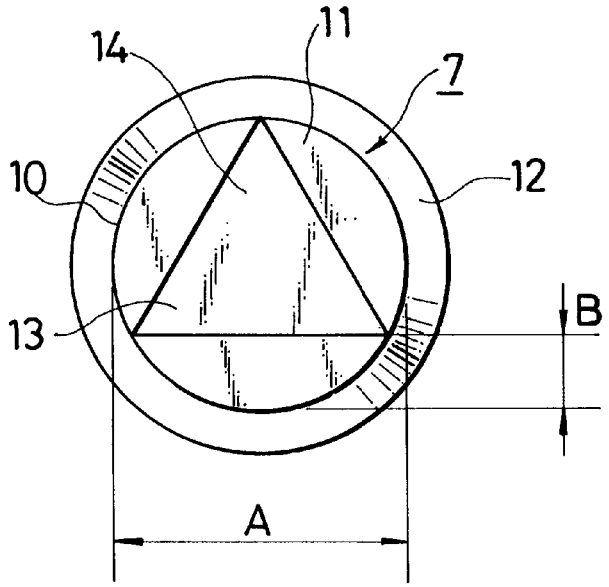
FIG. 3A is an enlarged fragmentary front view of a head portion of a center electrode in the spark plug according to the second embodiment of the present invention.
Figure 3B:
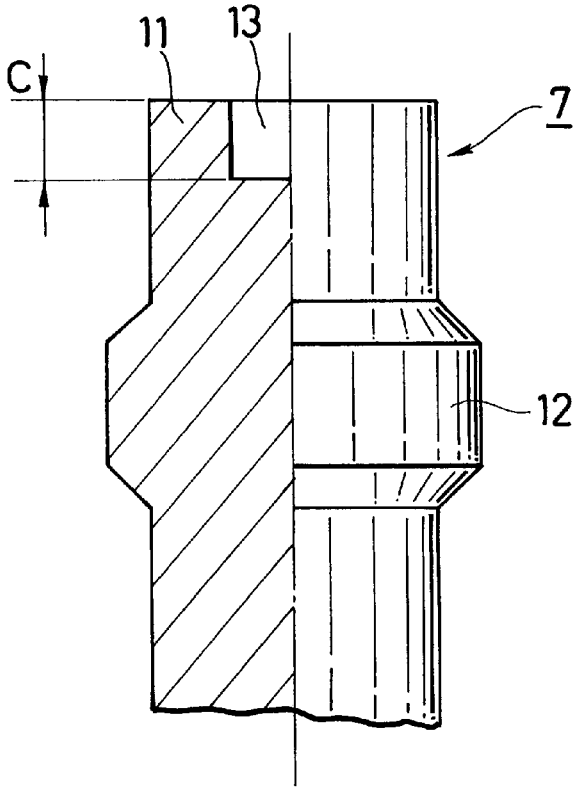
FIG. 3B is an enlarged fragmentary cross-sectional view of the head portion of 3A.
Figure 4A:
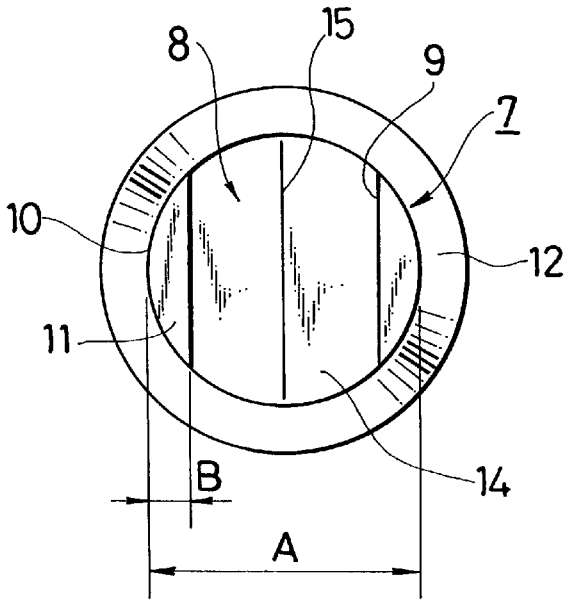
FIG. 4A is an enlarged fragmentary cross-sectional view of a head portion of a center electrode in a spark plug according to a modification of the first embodiment of the present invention.
Figure 4B:
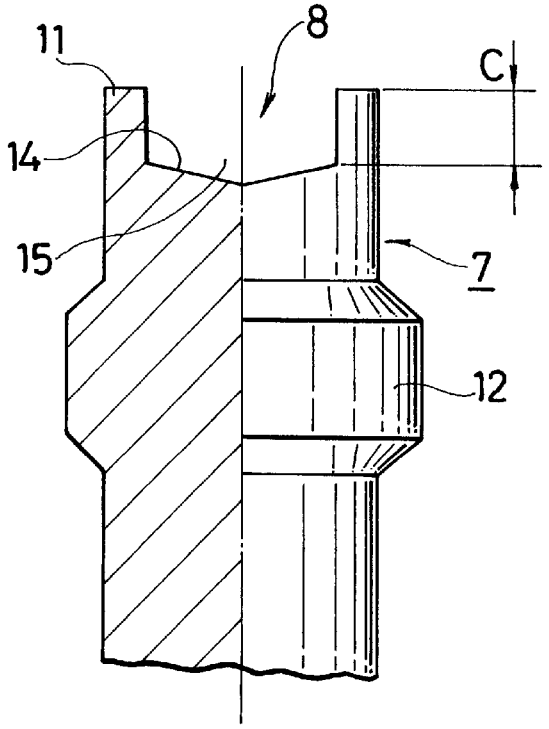
FIG. 4B is an enlarged fragmentary cross-sectional view of the head portion of FIG. 4A.
Figure 5A:
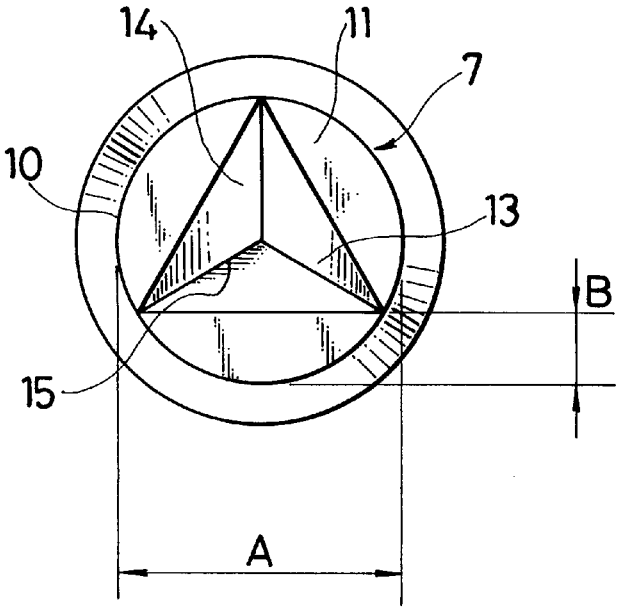
FIG. 5A is an enlarged fragmentary cross-sectional view of a head portion of a center electrode in a spark plug according to a modification of the second embodiment of the present invention.
Figure 5B:
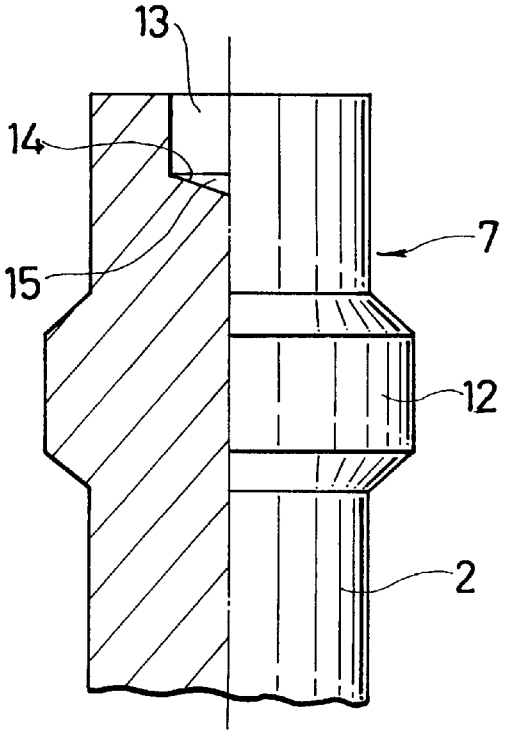
FIG. 5B is an enlarged fragmentary cross-sectional view of the head portion of FIG. 5A.

Referring next to FIG. 3A and FIG. 3B, the spark plug according to the second embodiment of the present invention for an internal combustion engine will be described. In the second embodiment, a right triangular prismatic recess 13 having a bottom 14 is formed in a head portion 7 of a center electrode 6 in the spark plug 1 with vertices thereof located in internal contact with a peripheral edge portion 10 of the center electrode 6 to satisfy the following formulas:

$$13 \leqq B/A \times 100 \leqq 40$$

$$10 \leqq C/A \times 100 \leqq 35$$

where

A: diameter of the head portion 7 of the center electrode 6,

B: maximum distance from one of sides connecting together the vertices, which are located in internal contact with the peripheral edge portion 10 of the center electrode 6, to the peripheral edge portion 10 of the center electrode, and C: height of projections 11 formed in the head portion 7 of the center electrode 6 as a result of the formation of the recess 13.

As the center electrode 6 fixedly held within the axial bore 3 of the insulator 2 in the spark plug 1 according to the second embodiment of the present invention is constructed as described above, it is possible, as in the above-described first embodiment of the present invention, to prevent deformation of the head portion 7 of the center electrode 6 under a pressure which is applied through the terminal electrode 4 upon first filling a glass sealing material 5 in the form of powder in the axial bore 3 and/or then heating the powdery glass sealing material 5 to fixedly seal the center electrode 6 with the glass seal 5 within the axial bore 3 of the insulator 2. Accordingly, the glass sealing material 5 is surely allowed to flow to a peripheral side wall of the flange portion 12 of the center electrode 6 and moreover, the mechanical fitting engagement between the glass seal 5 and the head portion 7 of the center electrode 6 is improved by the right triangular prismatic recess 13 formed in the head portion of the center electrode 6. The bonding strength between the center electrode 6 and the insulator 2 is thus enhanced, so that the impact resistance to impact force produced as a result of combustion of an air-fuel mixture within a combustion chamber of an internal combustion engine, said impact resistance being required for the spark plug 1 to be fitted in the internal combustion engine, is fully improved.

In the above-described second embodiment, the recess 13 is in the right triangular prismatic form. The recess 13 is however not limited to the right triangular prismatic form but may be in the form of a non-right triangular prismatic form or another polygonal prismatic form.

With reference to FIGS. 4A and 4B and FIGS. 5A and 5B, the modifications of the first and second embodiments of the present invention will now be described. A conical or triangular pyramidal depression 15 is formed in a bottom 14 of the groove 8 or right triangular prismatic recess 13 formed in the head portion 7 of the cylindrical center electrode 6. The mechanical fitting engagement, which has been obtained by the formation of the groove 8 or the right triangular prismatic recess 13 in the head portion 7 of the center electrode 6, is further enhanced by the depression 15, whereby the bonding strength between the center electrode 6 an the insulator 2 is increased to provide increased impact resistance against impact force produced as a result of combustion of an air-fuel mixture. In addition, the mechanical fitting engagement between the glass seal 5 and the head portion 7 of the center electrode 6 is also improved further so that the bonding strength between the center electrode 6 and the insulator 2 is significantly enhanced. The spark plug 1 is provided with significantly-improved impact resistance.

It is to be noted that the depression (15) is however not limited to the conical or triangular pyramidal form but may be in another polygonal pyramidal form such as a square pyramidal form.

To confirm the advantages of the present invention, two tests were conducted, one being an impact resistance test under the conditions specified in JIS B8031, 3.3 and the other a test concerning the filling readiness of a glass sealing material when heated to 850° C. As test samples, the following spark plugs were produced by setting the diameter A of the head portion 7 of the center electrode 6 at 2.9 mm but by varying the maximum distance B from the edge portion of the groove 8 or the side of the recess 13, which is formed in the head portion 7 of the center electrode 6, to the peripheral edge portion 10 of the center electrode 6 and also the height C of the projections 11 formed in the head portion 7 of the center electrode 6 as a result of the formation of the groove 8 or the recess 13:

Sample Nos. 1 to 10

Spark plugs similar to the first embodiment of the present invention, which were each provided with a groove 8 in a head portion 7 of a center electrode 7.

Sample Nos. 11 to 16

Spark plugs similar to the modification of the first embodiment, which were each provided with a conical depression 15 in a bottom of a groove 8.

Sample Nos. 17 to 19

Spark plugs similar to the second embodiment of the present invention, which were each provided with a right triangular prismatic recess 13 formed in a head portion 7 of a center electrode 6 with vertices thereof located in internal contact with a peripheral edge portion 10 of the center electrode 6.

Sample Nos. 20 to 22

Spark plugs similar to the modification of the second embodiment, which were each provided with a conical depression 15 in a bottom 14 of the right triangular prismatic recess 13.

Sample Nos. 23 to 25

Spark plugs similar to another modification of the second embodiment, which were each provided with a conical depression 15 in a bottom 14 of a square prismatic recess 13 formed in a head portion 7 of a center electrode 6 with vertices thereof located in internal contact with a peripheral edge portion 10 of the center electrode 6.

The results of the tests are shown together with values of A, B and C in the following table. Sample Nos. 1, 2, 8 to 12, 14 to 16 and 24 are comparative examples and were found to be somewhat inferior or poor in impact resistance and/or in the filling readiness of the glass sealing material. Sample Nos. 3 to 7, 13, 17 to 23 and 25, on the other hand, are invention examples and were found to be excellent or good at least in one of impact resistance and/or in the filling readiness of the glass sealing material.

| Sample No. | A (mm) | B (mm) | C (mm) | B/A | C/A | Impact resistance under JIS B8031, 3.3 | Filling readiness of glass sealing mat'l (at 850° C.) |
|---|---|---|---|---|---|---|---|
| 1 | 2.9 | 0.30 | 0.20 | 0.103 | 0.069 | E | C |
| 2 | 2.9 | 0.30 | 1.20 | 0.103 | 0.414 | D | E (substantial deformation) |
| 3 | 2.9 | 0.50 | 0.35 | 0.172 | 0.121 | C | A |
| 4 | 2.9 | 0.50 | 1.00 | 0.172 | 0.345 | A | C |
| 5 | 2.9 | 0.80 | 0.50 | 0.276 | 0.172 | A | A |
| 6 | 2.9 | 1.00 | 0.35 | 0.345 | 0.121 | B | C |
| 7 | 2.9 | 1.00 | 1.00 | 0.345 | 0.345 | A | C |
| 8 | 2.9 | 1.30 | 0.20 | 0.448 | 0.069 | D | C |
| 9 | 2.9 | 1.30 | 0.50 | 0.448 | 0.172 | D | D |
| 10 | 2.9 | 1.30 | 1.20 | 0.448 | 0.414 | D | E (substantial deformation) |
| 11 | 2.9 | 0.30 | 0.20 | 0.103 | 0.069 | E | C |
| 12 | 2.9 | 0.30 | 1.20 | 0.103 | 0.414 | D | E (substantial deformation) |
| 13 | 2.9 | 0.80 | 0.50 | 0.276 | 0.172 | A | A |
| 14 | 2.9 | 1.30 | 0.20 | 0.448 | 0.069 | D | C |
| 15 | 2.9 | 1.30 | 0.50 | 0.448 | 0.172 | D | D |
| 16 | 2.9 | 1.30 | 1.20 | 0.448 | 0.414 | D | E (substantial deformation) |
| 17 | 2.9 | 0.775 | 0.50 | 0.267 | 0.172 | A | A |
| 18 | 2.9 | 0.50 | 0.50 | 0.172 | 0.172 | C | A |
| 19 | 2.9 | 1.00 | 0.50 | 0.345 | 0.172 | A | A |
| 20 | 2.9 | 0.775 | 0.50 | 0.267 | 0.172 | A | A |
| 21 | 2.9 | 0.50 | 0.50 | 0.172 | 0.172 | C | A |
| 22 | 2.9 | 1.00 | 0.50 | 0.345 | 0.172 | A | A |

-continued

| Sample No. | A (mm) | B (mm) | C (mm) | B/A | C/A | Impact resistance under JIS B8031, 3.3 | Filling readiness of glass sealing mat'l (at 850° C.) |
|---|---|---|---|---|---|---|---|
| 23 | 2.9 | 0.40 | 0.50 | 0.138 | 0.172 | C | A |
| 24 | 2.9 | 0.30 | 0.50 | 0.103 | 0.172 | D | D |
| 25 | 2.9 | 1.00 | 0.50 | 0.345 | 0.172 | B | C |

Ranking standard of impact resistance and the filling readiness of the glass sealing material:
A: Excellent
B: Good
C: Average
D: Somewhat inferior
E: Poor

What is claimed is:

1. A spark plug for an internal combustion engine, said spark plug having:

an insulator defining therein an axial bore including a small-diameter forward bore and a large-diameter rearward bore divided from each other by a stepped portion, a cylindrical center electrode provided with a head portion and a large-diameter flange portion arranged in continuation with said head portion, said cylindrical center electrode being inserted in said small-diameter bore with said flange portion maintained in engagement with said stepped portion, a terminal electrode, and a glass seal integrally sealing said head portion and said terminal electrode within said large-diameter bore, wherein a diametrically-extending groove is formed in said head portion of said center electrode to satisfy the following formulas:

$$13 \leqq B/A \times 100 \leqq 40$$

$$10 \leqq C/A \times 100 \leqq 35$$

where

A: diameter of said head portion of said center electrode,

B: maximum distance from an edge portion of said groove, which is formed in said head portion of said center electrode, to a peripheral edge portion of said center electrode, and C: height of projections formed in said head portion of said center electrode as a result of the formation of said groove.

2. The spark plug according to claim 1, wherein a downwardly-pointed depression is formed in a bottom of said groove formed in said head portion of said center electrode.

3. The spark plug according to claim 2, wherein said downwardly-pointed depression is a conical depression.

4. The spark plug according to claim 2, wherein said downwardly-pointed depression is a polygonal pyramidal depression.

5. The spark plug according to claim 4, wherein said polygonal pyramidal depression is a triangular pyramidal depression.

6. A spark plug for an internal combustion engine, said spark plug having:

an insulator defining therein an axial bore including a small-diameter forward bore and a large-diameter rearward bore divided from each other by a stepped portion, a cylindrical center electrode provided with a head portion and a large-diameter flange portion arranged in continuation with said head portion, said cylindrical center electrode being inserted in said small-diameter bore with said flange portion maintained in engagement with said stepped portion, a terminal electrode, and a glass seal integrally sealing said head portion and said terminal electrode within said large-diameter bore, wherein a polygonal prismatic recess is formed in said head portion of said center electrode with vertices thereof located in internal contact with a peripheral edge portion of said center electrode to satisfy the following formulas:

$$13 \leqq B/A \times 100 \leqq 40$$

$$10 \leqq C/A \times 100 \leqq 35$$

where

A: diameter of said head portion of said center electrode,

B: maximum distance from one of sides connecting together said vertices, which are located in internal contact with said peripheral edge portion of said center electrode, to said peripheral edge portion of said center electrode, and C: height of projections formed in said head portion of said center electrode as a result of the formation of said recess.

7. The spark plug according to claim 6, wherein said polygonal prismatic recess is a triangular prismatic recess.

8. The spark plug according to claim 7, wherein said triangular prismatic recess is a right triangular prismatic recess.

9. The spark plug according to claim 6, wherein a downwardly-pointed depression is formed in a bottom of said recess formed in said head portion of said center electrode.

10. The spark plug according to claim 9, wherein said downwardly-pointed depression is a conical depression.

11. The spark plug according to claim 9, wherein said downwardly-pointed depression is a polygonal pyramidal depression.

12. The spark plug according to claim 11, wherein said polygonal pyramidal depression is a triangular pyramidal depression.

* * * * *